United States Patent [19]

Culpepper

[11] 4,434,602

[45] Mar. 6, 1984

[54] TRAY LOADING MACHINE

[75] Inventor: Will L. Culpepper, Tucker, Ga.

[73] Assignee: The Mead Corporation, Atlanta, Ga.

[21] Appl. No.: 291,020

[22] Filed: Aug. 7, 1981

[51] Int. Cl.[3] ..... B65B 5/06

[52] U.S. Cl. ..... 53/473; 53/247; 53/252

[58] Field of Search ..... 53/475, 473, 244, 247, 53/251, 252, 537, 538; 198/425, 431, 471, 487, 732, 728, 489

[56] References Cited

U.S. PATENT DOCUMENTS

| | | | |
|---|---|---|---|
| 2,324,930 | 7/1943 | Joa | 53/537 |
| 2,570,030 | 10/1951 | Forster | 198/732 |
| 3,401,789 | 9/1968 | Schuster | 198/728 |
| 3,504,784 | 4/1970 | Noyes | 198/732 |
| 3,527,337 | 9/1970 | Formo | 198/732 |
| 3,775,938 | 12/1973 | Sutphin | 53/537 |
| 3,876,062 | 4/1975 | Honda | 198/732 |
| 4,164,278 | 8/1979 | Gurioli | 198/487 |

*Primary Examiner*—Horace M. Culver

[57] ABSTRACT

A tray loading mechanism for moving accumulated charges of containers from an accumulating position into trays at a loading position through the unclosed end flaps on the trays including a loading conveyor with endless support means movable along an endless path and mounting a plurality of pusher assemblies thereon at equally spaced apart positions therealong for movement between the accumulating and loading positions. A clutch mechanism selectively connects a first drive unit to the loading conveyor to move the pusher assemblies in a first direction along the endless path and a brake mechanism selectively connects a second drive unit to the loading conveyor to move the pusher assemblies in the opposite direction along the endless path so that the pusher assemblies are incrementally advanced in the first direction around the endless path by the first drive unit to engage and move the charges of containers from the accumulating station into the trays at the loading station and retracted a short distance in the opposite direction by the second drive unit after each incremental advancement in the first direction so that the pusher assembly loading a charge of containers in the tray just clears the unclosed end flaps of the tray. The method of operation thereof is also disclosed.

16 Claims, 7 Drawing Figures

2
14
32
42
10
20
11
12
21

65
60
62
14
41
58
46
32
40
49
56
35
11
ACCUMULATING POSITION
55
61
20
34
31
30
28
29
CHARGE
36
$P_{IN}$
64
12
24
22
25
21
26

TRAY LOADING MACHINE

BACKGROUND OF THE INVENTION

This invention relates generally to carton loading machines and more particularly to a machine for loading an accumulated charge of containers into a carton through an open end on the carton.

Groups of containers are packaged in open top cartons which have a bottom that supports the containers and upstanding flaps therearound to keep the group of containers in the cartons. These open top containers are commonly known as trays. Equipment is available for forming these trays and loading the containers in the tray to package the containers. Typically, this packaging equipment includes a tray handling machine which sets up the tray and positions the tray for loading with the containers, and a tray loading machine which accumulates charges of containers of sufficient size to fill the tray and loads the containers into the tray. In one such arrangement, the tray handling machine sets up the tray for receipt of the charge of containers whereby one set of the end flaps is left open and the thusly set up tray is located in a loading position adjacent the tray loading machine so that the tray loading machine can insert the accumulated charge of containers into the tray through the unclosed end flaps. After the tray has been loaded with the charge of containers, the tray handling machine moves the loaded tray out of the loading position, closes the unclosed end flaps on the tray, and finishes the packaging process such as by applying a heat shrink film about the tray and containers to maintain the package integrity.

In loading the charge of containers into the tray, the tray loading machine typically uses a pusher member to move the charge of containers from the accumulating position into the tray at the loading position. To do this, the pusher member must pass into interference with the unclosed end flaps of the tray. In order for the tray handling machine to move the loaded tray away from the loading position, the pusher member must be retracted out of interference with the unclosed end flaps of the tray.

One such prior art tray loading machine uses a single pusher member to load the containers in the tray. This pusher member is reciprocated back and forth along a linear path between the accumulating and loading positions by a crank arm mechanism such as that shown by U.S. Pat. No. 3,165,871. While such an arrangement does retract the pusher member out of interference with the unclosed end flaps of the loaded tray, it is necessary that the pusher member be extended all the way from the accumulating position to the loading position and retracted all the way from the loading position back past the accumulating position during each loading cycle. This prevented the accumulation of the next charge of containers at the accumulating position until the pusher member had fully reciprocally cycled. In order to achieve reasonable production rates, it was necessary that the pusher member be rapidly reciprocated. As a result, container handling reliability was reduced and wear of machine parts was increased. In order to produce the necessary reciprocatory motion, the drive for the pusher member was complex. As a result, high maintenance costs were associated therewith to keep these machines in operational condition.

SUMMARY OF THE INVENTION

These and other problems and disadvantages associated with prior art tray loading machines are overcome by the invention disclosed herein by using a plurality of pusher members moving along an endless path to successively move the charges of containers from the accumulating position into the tray at the loading position. The pusher members are incrementally advanced around the endless path in a first direction to load the charges of containers into the trays and then return from the loading position to the accumulating position. After each incremental advancement of the pusher members along the endless path in the first direction, the pusher members are moved a short distance along the endless path in the opposite direction just sufficient for the pusher member at the loading position to clear the unclosed end flaps of the loaded tray so that the loaded tray can be moved away from the loading position. As a result, the distance each pusher member is moved during each loading cycle is greatly reduced over that associated with prior art tray loading machines. For the same production rate, the speed of movement of the pusher members is much less than that of the prior art, thereby increasing container handling reliability and reducing wear of machine parts.

Because a plurality of pusher members are used rather than a single pusher member as was used by the prior art, it is not necessary that one of the pusher members of the invention move the entire distance between the accumulating position and the loading position during each loading cycle. As a result, the distance each pusher member is moved during the loading cycle is minimized. Also, the distance between the accumulating position and the loading position does not significantly affect the production rate and/or required speed of movement of the pusher members as was the case with the prior art. This allows greater flexibility in the positioning of the tray loading machine of the invention with respect to the tray handling machine used therewith to simplify machine installation and operation.

The tray loading machine of the invention includes an infeed section, an accumulating section, and a loading section. The infeed section moves rows of containers along parallel infeed paths into the accumulating section to accumulate a charge of containers at an accumulating position. The loading section moves the accumulated charges of containers from the accumulating position into the tray at the loading position through the unclosed end flaps of the tray.

The loading section includes a loading conveyor with plurality of pusher assemblies movable in a first direction along an endless path between the accumulating and loading positions. As each pusher assembly moves from the accumulating position toward the loading position, it moves an accumulated charge of containers therewith until the charge of containers is loaded into a tray at the loading position. First and second drive means is provided with connection means for connecting the drive means to the conveyor to drive it. The connection means alternatively connects and disconnects the first drive means to the conveyor to successively advance the pusher assemblies a first prescribed distance along the endless path in the first direction each time the first drive means is connected to the conveyor. Each time the first drive means is disconnected from the conveyor, the connection means connects the second drive means to the conveyor to move the pusher assemblies along the endless path in the opposite direction for a second prescribed distance less than the first prescribed distance just sufficient for the pusher assembly at the loading position to clear the unclosed end flaps of the tray.

The pusher assemblies are positioned on the loading conveyor so that each time one of the pusher assemblies is located at the loading position, another of the pusher assemblies will be located at the accumulating position. Thus, each time the loading conveyor is advanced in the first direction, a tray will be loaded with a charge of containers and the accumulating position will be cleared of the charge of containers. It will be appreciated, however, that a pusher assembly need not advance a charge of containers all the way from the accumulating position into the tray at the loading position each time the pusher assemblies are advanced in the first direction along the endless path. As a result, the distance each pusher assembly is advanced along the endless path in the first direction can be minimized while permitting greater distances between the accumulating and loading positions to accommodate the physical machine size without affecting the overall packaging rate.

The connection means includes a fluid operated clutch brake with the clutch section connecting the conveyor to the first drive means and the brake section connecting the conveyor to the second drive means. The first drive means is a continuously operating motor drive unit while the second drive means is a fluid cylinder. Control means is provided for delaying the operation of the fluid cylinder in one direction until the brake unit is fully engaged to insure that the pusher assemblies on the loading conveyor will be moved the second prescribed distance in the opposite direction along the endless path.

These and other features and advantages of the invention will become more apparent upon consideration of the following description and accompanying drawings wherein like characters of reference designate corresponding parts throughout the several views and in which:

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

The tray loading machine of the invention is adapted to load a group or charge of containers such as cans, bottles and the like into conventional open top trays through the open end thereof. Such trays have a bottom which supports the containers and upstanding flaps therearound to keep the group of containers in the tray after it is loaded. For loading, one set of end flaps is left unclosed so that the charge of containers can be loaded into the tray through these unclosed end flaps. Since such trays are conventional, they need not be described in detail.

The trays are typically handled by a conventional tray handling machine which operates in conjunction with the tray loading machine. The operation of such tray handling machines is well known and will not be described in detail. For purposes of understanding the operation of the tray loading machine, it will be appreciated that such tray handling machine partly sets up a tray blank by folding up the side flaps of the tray blank and closing one set of the end flaps of the tray so that the open top container receiving space in the tray can be loaded from that end with the unclosed end flaps. The partly set up tray is then moved to a loading position where it is loaded with a charge of containers by the tray loading machine. After loading, the tray handling machine moves the loaded tray out of the loading position, closes the unclosed end flaps on the tray, and finishes the packaging process, typically by applying a heat shrink film about the tray and containers to maintain the packing integrity.

Figure 1:
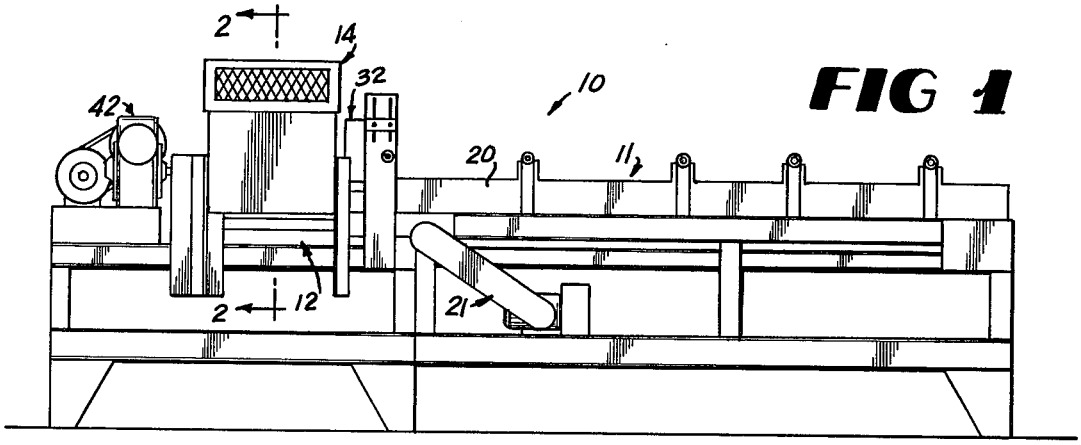
FIG. 1 is a side elevational view of a tray loading machine incorporating the invention.

The tray loading machine 10 of the invention as seen in FIG. 1 includes an infeed section 11, an accumulating section 12 and a loading section 14. The infeed section 11 feeds a plurality of rows of containers along parallel infeed paths into the accumulating section 12 as is well known in the art. The accumulating section 12 accumulates a charge of containers of predetermined size at an accumulating position. After the charge of containers is accumulated in the accumulating section 12, the loading section 14 moves the charge of containers along a loading path normal to the infeed paths into the partly set tray at the loading position through the unclosed end flaps on the tray.

ACCUMULATING SECTION

Figure 3:
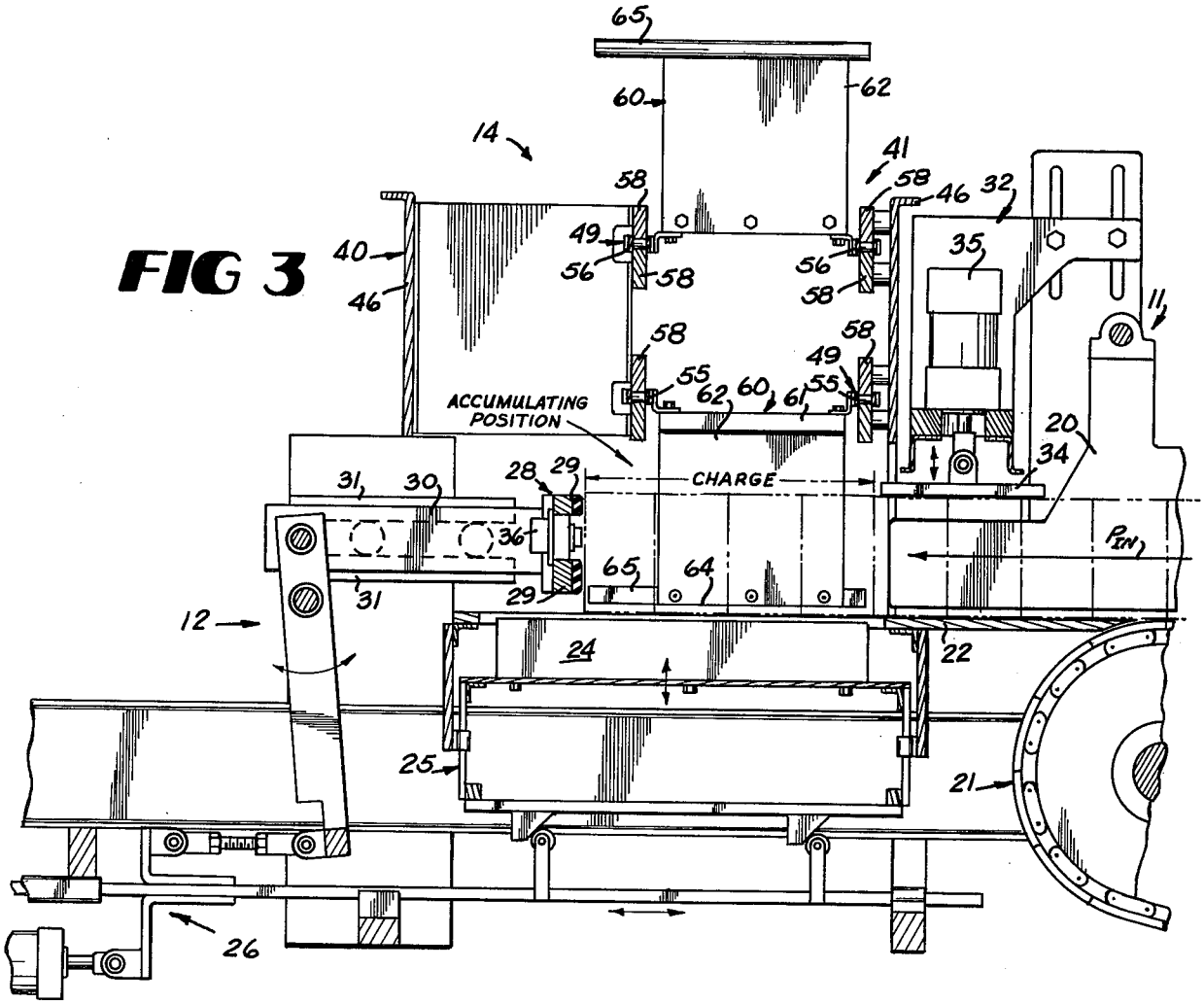
FIG. 3 is a cross-sectional view taken generally along line 3—3 in FIG. 2.
Figure 2:
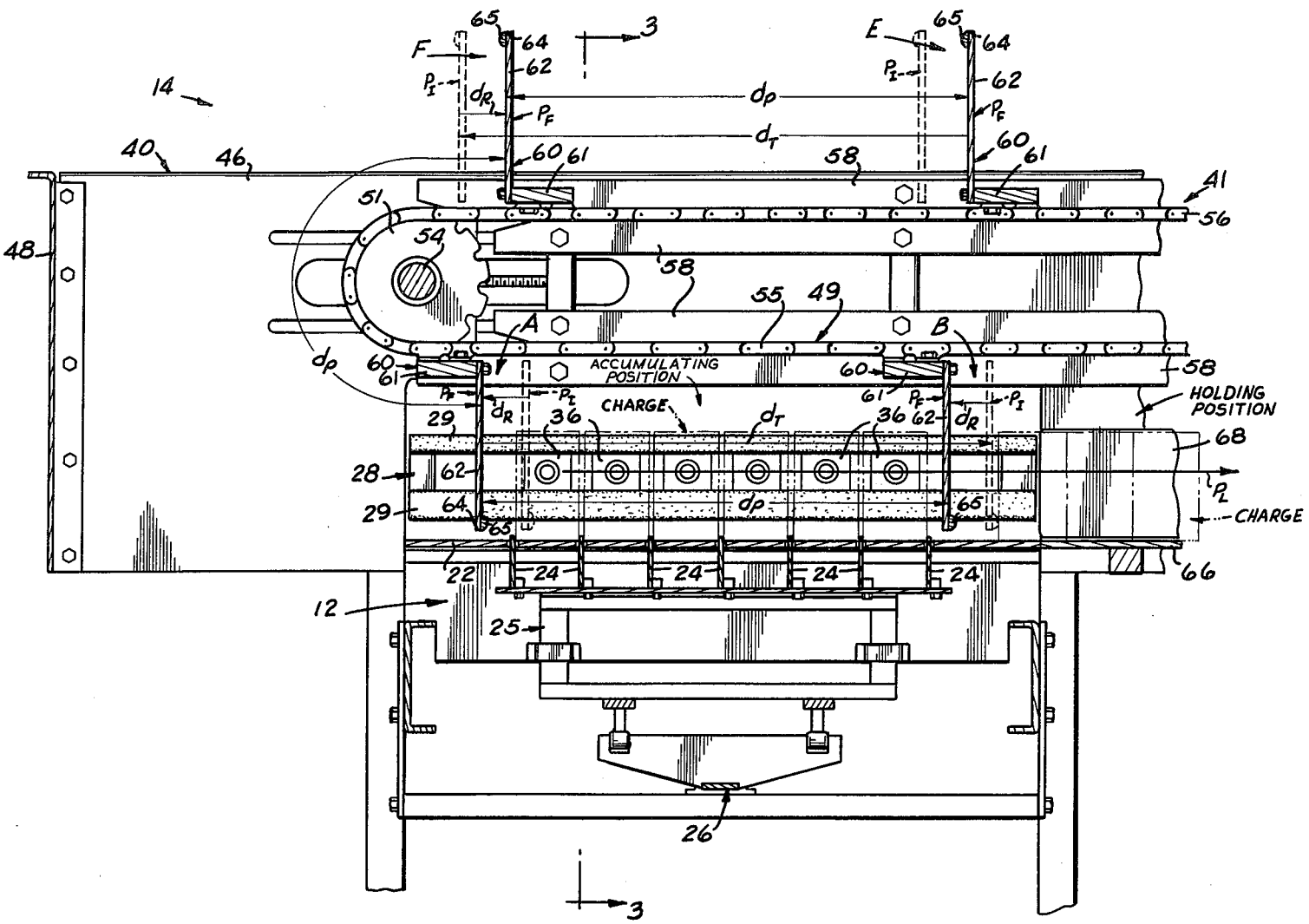
FIG. 2 is an enlarged cross-sectional view taken generally along line 2—2 in FIG. 1 of the accumulating position in the machine.

The accumulating section 12 is best seen in FIGS. 2 and 3. The containers are moved in rows along horizontal infeed paths $P_{IN}$ into the accumulating section 12 by the infeed section 11 between vertically oriented, parallel stationary guide plates 20 seen in FIG. 3 on an infeed conveyor 21 as is well known in the art. The rows of containers are discharged off the infeed conveyor 21 onto a horizontally oriented slide plate 22 which extends across the accumulating section 12. The stationary guide plates 20 extend partly across the slide plate 22 up to the accumulating position to keep the containers in parallel rows as they are forced across slide plate 22 by the containers still on the infeed conveyor 21.

To keep the containers in parallel rows on the slide plate 22 after they exit the guide plates 20, a plurality of movable guide plates 24 are provided which project up through appropriate slots in the slide plate 22 so as to be in registration with the stationary guide plates 20. To release the accumulated charge of containers for movement along the horizontal loading path $P_L$ normal to infeed paths $P_{IN}$ by the loading section 14, the movable guide plates 24 are mounted on an elevating frame 25 movably mounted for vertical movement. An appropriate positioning mechanism 26 is connected to the elevating frame 25 to selectively raise the guide plates 24 above the slide plate 22 as seen in FIG. 2 to guide the rows of containers moving into the accumulating section 12 by the infeed section 11, and to lower the guide plates 24 below the upper surface of the slide plate 22 as seen in FIG. 3 so that the charge of containers can move thereover as the loading section 14 moves the charge out of the accumulating position.

To arrest the movement of the containers into the accumulating section 12 at the accumulating position, a stop mechanism 28 is provided as seen in FIGS. 2 and 3. The stop mechanism 28 includes a pair of stop bars 29 which extend across the accumulating position to engage the leadingmost container in each row of containers being moved into the accumulating position by the infeed section 11 and stop the movement of each row of containers so that the accumulated charge is in proper registration with the loading section 12 for engagement thereby to move the charge to the loading position. The stop bars 29 are mounted on side members 30 movably carried on support members 31 so that the stop bars 29 can be moved toward and away from the discharge end of the infeed section 11. This allows the stop bars 29 to be selectively extended toward the infeed section 11 to an arresting position to stop the movement of the rows of containers from the infeed section 11 during the accumulation of the charge of containers and then retracted away from the discharge end of the infeed section as seen in FIG. 3 by an amount just sufficient to release the charge of containers for movement by the loading section 12 as will become more apparent. While different arrangements may be used to position the stop mechanism 28, it is illustrated connected to the positioning mechanism 26 which serves to extend stop bars 29 to the arresting position when the movable guide plates 24 are raised and to retract the stop bars 29 when the movable guide plates 24 are lowered.

A lock out mechanism 32 seen in FIG. 3 is provided to prevent movement of the containers upstream of the accumulated charge into the accumulating position while the loading section 14 is shifting the accumulated charge toward the loading position. The lock out mechanism 32 includes a plurality of clamping plates 34, one being associated with each row of incoming containers from the infeed section 11. Each of the clamping plates 34 is vertically positioned by a lock out cylinder 35. The clamping plates 34 are located in registration with the containers in each row immediately upstream of the accumulated charge of containers in the accumulating position. When the lock out cylinders 35 are extended, the clamping plates 34 are lowered onto the tops of the containers in registration therewith as seen in FIG. 3 to clamp these containers between the clamping plates 34 and the slide plate 22. This locks the containers immediately upstream of the accumulated charge in place to prevent movement of each row of containers upstream of the accumulated charge into the accumulating position as long as the clamping plates 34 are lowered. When the cylinders 35 are retracted, each row of containers is released for movement into the accumulating position.

In the operation of the accumulating section 12, the infeed section 11 moves the rows of containers into the accumulating position while the stop bars 29 of stop mechanism 28 are extended to their arresting positions and the movable guide plates 24 are raised. When the charge of containers has accumulated in section 12, the clamping plates 34 are lowered to clamp the containers in the incoming rows immediately upstream of the accumulated charge. After the lock out mechanism 32 has clamped these containers, the stop bars 29 are retracted just sufficiently to release the containers in the charge while the movable guide plates 24 are lowered below the upper surface of the slide plate 22. This operation is well known in the art. The accumulated charge of containers is now ready to be moved from the accumulating section 12 toward the loading position by the loading section 14 as will be explained. After the accumulated charge of containers has been moved out of the accumulating position by the loading section 14, the accumulating section 12 is ready to receive another charge of containers. The stop bars 29 are extended back to their arresting position while the movable guide plates 24 are raised. The clamping plates 34 in the lock out mechanism 32 are again raised to release the rows of containers in the infeed section 11 for movement into the accumulating section 12 to form another charge. This sequence of operation is then repeated.

It is understood that different numbers and sizes of containers may be accumulated in the accumulating section 12 to form a charge of containers without departing from the scope of the invention. For sake of illustration, the loading machine 10 is illustrated as accumulating twenty-four containers in each charge of six rows of containers with four containers in each row.

To insure that the correct number of containers has been accumulated in section 12 to form the charge, a set of detection switches 36 is mounted between the stop bars 29. One of the switches 36 is provided for each row of containers and is arranged so that, when all of the switches 36 are actuated by the containers, the full charge will be accumulated.

LOADING SECTION

As mentioned above, the loading section 14 is adapted to successively move accumulated charges of containers from the accumulating position into the partly set up tray at the loading position along the horizontal loading path $P_L$ normal to the infeed paths. The loading section 14 includes a support frame 40 which mounts a loading conveyor 41 therein extending between the accumulating and loading positions, a first drive unit 42, a second drive unit 44, and a connection unit 45 for selectively connecting the drive units 42 and 44 to the loading conveyor 41 to drive same.

The support frame 40 includes a pair of spaced apart side members 46 joined at opposite ends by end members 48. Frame 40 is mounted on the basic machine framework so that it spans the accumulating and loading positions and is generally horizontally oriented. The side members 46 are parallel to the loading path $P_L$.

Figure 4:
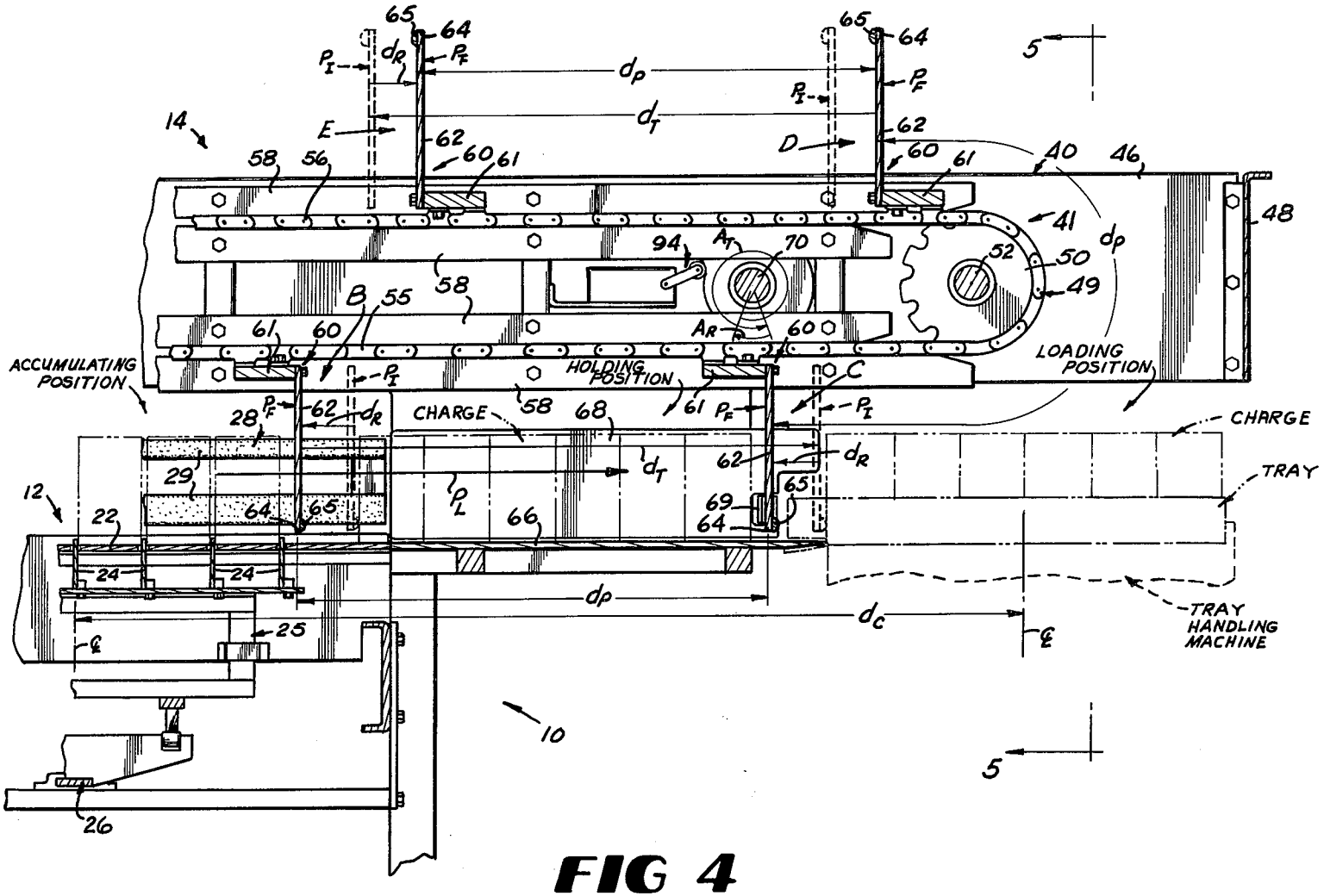
FIG. 4 is an enlarged cross-sectional view taken generally along line 2—2 in FIG. 1 of the loading position in the machine.

The loading conveyor 41 is mounted between the side members 46 and includes a pair of spaced apart endless conveyor chains 49. Each of the conveyor chains 49 is trained around a pair of spaced apart sprockets 50 and 51. Sprockets 50 for both chains 49 are mounted on a common drive shaft 52 at the right hand end of the loading section 12 as seen in FIG. 4 at the loading position while sprockets 51 are mounted on a common idler shaft 54 at the left hand end of the loading section 12 adjacent the accumulating position as seen in FIG. 2. Shafts 52 and 54 are rotatably journalled in bearings carried by the side members 46 so that their axes of rotation lie in a common horizontal plane and are normal to the loading path $P_L$. This locates the conveyor chains 49 in spaced apart vertical planes parallel to each other and the loading path $P_L$. Thus, each of the conveyor chains 49 has lower and upper flights 55 and 56 extending between the sprockets 50 and 51 as best seen in FIGS. 2 and 4. The lower and upper flights 55 and 56 are slidably supported between guide rails 58 supported from side members 46 by appropriate brackets. The lower flights 55 of chains 49 are horizontally oriented and spaced above the slide plate 22 in the accumulating position a common distance greater than the height of the containers being loaded so as not to interfere therewith as will become more apparent.

A plurality of pusher assemblies 60 are mounted between the conveyor chains 49 to engage the accumulated charges of containers and move the charges from the accumulated position into the tray at the loading position as the pusher assemblies 60 move along the lower flights 55 of chains 49. The length and orientation of the lower flights 55 of chains 49 are such that each pusher assembly 60 moves across the accumulating position and to the loading position while it moves along the lower flights 55. The pusher assemblies 60 are equally spaced along the chains 49 so that each pusher assembly 60 is spaced from the pusher assemblies 60 adjacent thereto by a common distance $d_p$ which is greater than the length of the accumulated charges of containers at the accumulating position so that each charge can be accumulated between adjacent pusher assemblies 60 as seen in FIG. 2.

Figure 5:
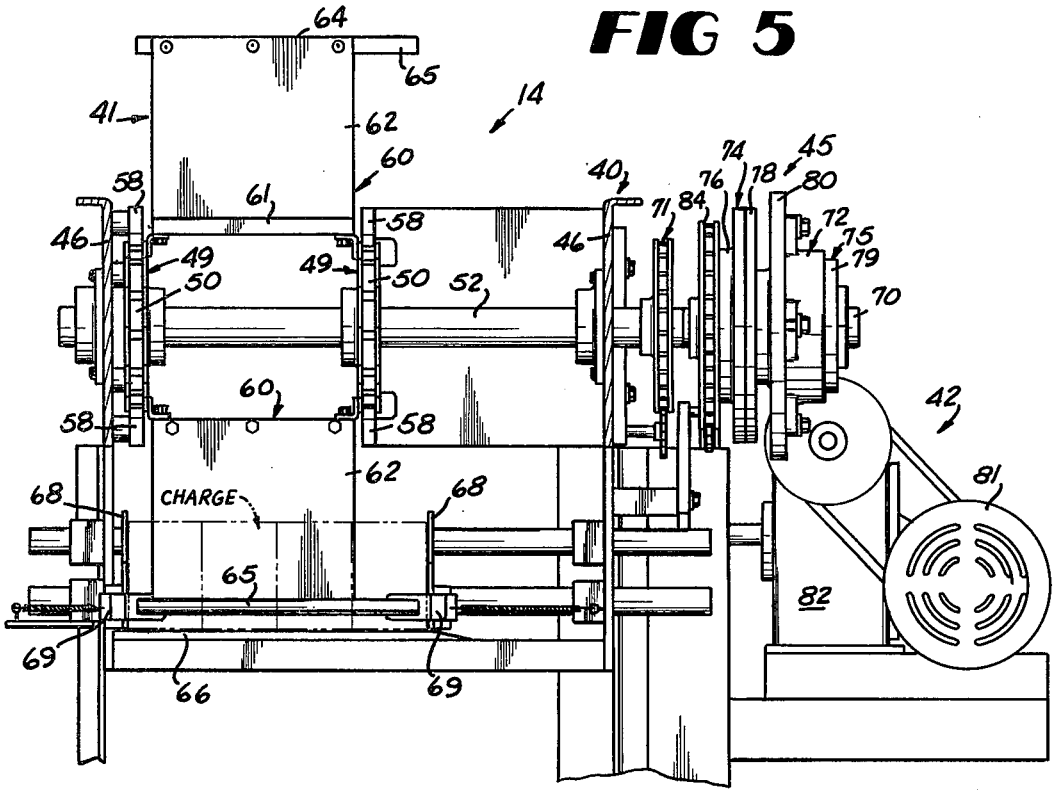
FIG. 5 is a cross-sectional view taken generally along line 5—5 in FIG. 4.

Each of the pusher assemblies 60 includes a carrier bar 61 mounted between chains 49 so that it is oriented normal to the loading path $P_L$. The carrier bar 61 mounts a pusher plate 62 thereon which extends away from the chains 49 so that the pusher plate 62 is vertically oriented normal to loading path $P_L$ as the pusher assembly 60 moves along the lower flights 55 of chains 49. The pusher plate 62 depends below the lower flights 55 as the pusher assembly moves along flights 55 so that its projecting edge 64 is located just above the slide plate 22. A pusher bar 65 is mounted on the leading surface of pusher plate 62 adjacent the projecting edge 64 to engage the charge of containers. The pusher bar 65 is horizontally oriented normal to the loading path $P_L$ as the pusher assembly 60 moves along the lower flights 55 of chains 49. The pusher bar 65 is spaced above the top of the slide plate 22 as it moves along the lower flights 55 to clear same but is located below the center of gravity of the containers. As best seen in FIGS. 3 and 5, pusher bar 65 has a length slightly less than the width of the charge of containers and is mounted on pusher plate 62 so that it is centered across the width of the charge to engage all of the containers in the trailing row of containers in the charge to move the charge of containers therewith as the pusher assembly 60 moves from the accumulating position to the loading position on the lower flights 55 of chains 49 (i.e. from the left to the right as seen in FIGS. 2 and 4).

To support the charge of containers as the pusher bar 65 moves the charge toward the loading station, a horizontally oriented slide plate 66 is mounted between the side members 46 coplanar with the slide plate 22 and extends from the right hand side of slide plate 22 to the loading position as seen in FIGS. 2 and 4. As each pusher bar 65 pushes the charge of containers out of the accumulating position, the sides of the charge are maintained in alignment by the retracted stop bars 29 and the containers locked in position by the clamping plates 34 on the lock out mechanism 32 as seen in FIG. 3. To keep the sides of the charge in alignment after the containers in the charge clear the accumulating position, a pair of upstanding adjustable guide plates 68 are provided on opposite sides of the charge. The guide plates 68 are adjustably mounted from side members 46 as seen in FIG. 5 and extend from the accumulating position to the loading position as best seen in FIG. 4.

Figure 6:
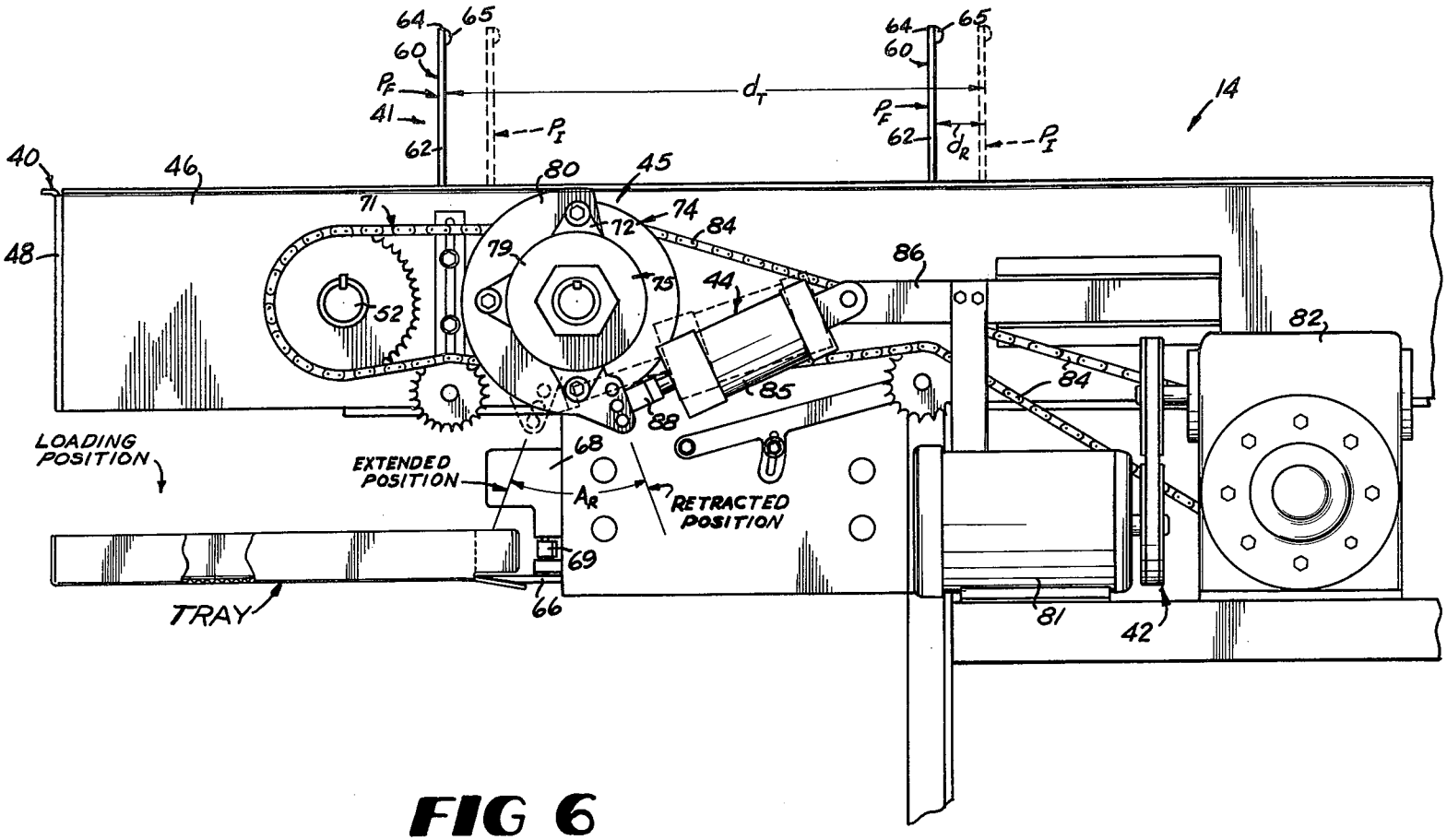
FIG. 6 is an elevational view of the drive side of the loading section of the machine.

That end of the slide plate 66 at the loading position is tapered as best seen in FIGS. 4 and 6 so that the unfolded end flap attached to the bottom of the tray extends under the end of slide plate 66 while the unfolded end flaps attached to the side flaps of the tray extend over the end of the slide plate 66 when the tray handling machine has moved the tray into the loading position. This locates the upper surface of the bottom of the tray substantially coplanar with the upper surface of slide plate 66 so that the charge of containers will slide off the end of slide plate 66 onto the bottom of the tray. It is understood that the container receiving sapce in the tray is centered on the incoming charge of containers while it is in the loading position.

To insure that the unclosed end flaps attached to the side flaps of the tray are open when the charge of containers is loaded into the tray, a pair of conventional flap openers 69 are provided as seen in FIGS. 4–6. These flap openers 69 are mounted on the guide plates 66 adjacent the ends thereof at the loading position. The containers on opposite sides of the charge engage the openers 69 as the charge is moved into the loading position to pivot them outwardly and engage the enclosed end flaps on the side flaps so that these end flaps are displaced outwardly to clear the charge. After the charge and the pusher bar 65 loading the charge passes the openers 69, they are spring urged back to the position shown in the figures out of interference with these end flaps so that the loaded tray can be moved out of the loading position.

The connection unit 45 is best seen in FIGS. 5 and 6 and is mounted on a transfer shaft 70 rotatably journalled between side members 46 so that shaft 70 is spaced from and parallel to drive shaft 52. The transfer shaft 70 is drivingly connected to drive shaft 52 through an appropriate chain and sprocket arrangement 71 so that rotation of transfer shaft 70 causes rotation of drive shaft 52 and movement of the pusher assemblies 60 along the endless path of conveyor chains 49.

The connection unit 45 is illustrated as a conventional fluid operated clutch brake. The unit 45 as best seen in FIG. 5 has a base section 72 rotatably journalled on the transfer shaft 70, a clutch section 74 and a brake section 75. The clutch section 74 includes an input member 76 rotatably journalled on shaft 70 and an output member 78 fixedly mounted on shaft 70. When fluid under pressure is supplied to the clutch section 74 to activate same, the input member 76 is drivingly connected to the output member 78 so that rotation of input member 76 causes rotation of the transfer shaft 70. When the fluid pressure is removed from the clutch section 74 to deactivate same, the output member 78 is disconnected from input member 76 so that input member 76 is free to rotate without rotating the output member 78. The brake section 75 includes a brake member 79 fixedly mounted on the transfer shaft 70. When fluid under pressure is supplied to the brake section 75 to activate it, the brake member 79 is fixedly connected to the base section 72 to prevent rotation of shaft 70 with respect to the base section 72. When the fluid pressure is removed from the brake section 75 to deactivate same, the brake member 79 is disconnected from the base section 72 so that the brake member 79 and shaft 70 are free to rotate with respect to the base section 72.

The base section 72 is mounted on a base plate 80 best seen in FIG. 6 to rotationally position the base section 72 about the shaft 70. The input member 76 of the clutch section 74 is driven by the first drive unit 42 while the base plate 80 is positioned by the second drive unit 44.

The first drive unit 42 includes a drive motor 81 with a gear reducer 82. The output of the gear reducer 82 is drivingly connected to the input member 76 by drive chain 84. The drive chain 84 is moved in a clockwise direction as seen in FIG. 6 to rotate the transfer and drive shafts 70 and 52 in a clockwise direction when the clutch section 72 is activated. This serves to move the conveyor chains 49 and pusher assemblies 60 in a counterclockwise direction as seen in FIGS. 2 and 4. Thus, when the clutch section 74 is activated, the pusher assemblies 60 on the lower flights 55 of chains 49 are moved from the left to the right toward the loading position as seen in FIGS. 2 and 4.

The second drive unit 44 includes a fluid cylinder 85 pinned to a support bracket 86 fixed with respect to the frame 40. The piston rod 88 of cylinder 85 is pinned to the base plate 80 so that, as the piston rod 88 is extended, the base plate 80 and base section 72 on connection unit 45 are rotated in a clockwise direction as seen in FIG. 6 to an extended position shown by dashed lines in FIG. 6. As the piston rod 88 is retracted, the base plate 80 and base section 72 on connection unit 45 are rotated in a counterclockwise direction to a retracted position shown by solid lines in FIG. 6. Thus, it will be seen that cylinder 85 rotates the base plate 80 and base section 72 back and forth through the angle $A_R$ seen in FIG. 6.

As will become more apparent, the piston rod 88 is extended while the brake section 75 is deactivated so that the base plate 80 and base section 72 are rotated in the clockwise direction without rotating the brake member 79 and transfer shaft 70 therewith. On the other hand, the piston rod 88 is retracted while the brake section 75 is activated so that the brake member 79 and transfer shaft 70 are rotated in a counterclockwise direction with the base plate 80 and base section 72 through the angle $A_R$. This serves to also rotate the drive shaft 52 in the counterclockwise direction as seen in FIG. 6 (the clockwise direction as seen in FIG. 4). Thus, the conveyor chains 49 are moved in the clockwise direction as seen in FIG. 4 as the piston rod 88 is retracted to shift the pusher assemblies 60 on the lower flights 55 of chains 49 from the right to the left as seen in FIGS. 2 and 4.

Figure 7:
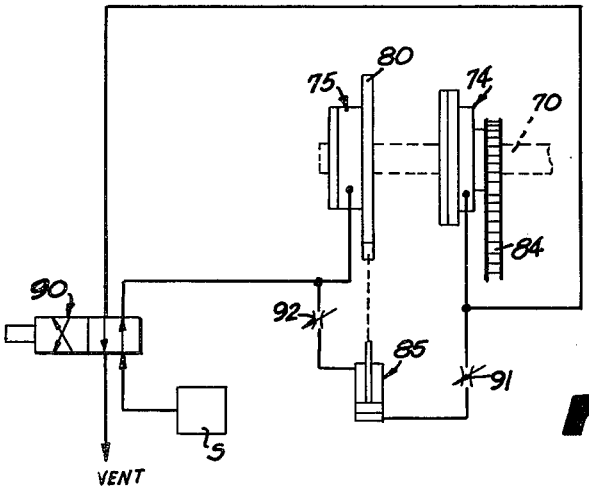
FIG. 7 is a fluid schematic for the clutch brake unit of the invention.

Fluid under pressure is supplied to the clutch brake 45 and the fluid cylinder 85 through a two-position solenoid valve 90 as seen in FIG. 7. One output of the valve 90 is connected directly to the clutch section 74 and to the closed end of cylinder 85 through a variable flow throttling valve 91. The other output of valve 90 is connected directly to the brake section 75 and to the rod end of cylinder 85 through a throttling valve 92. When the valve 90 is in the position shown, fluid under pressure from source S is imposed on the brake section 75 to fix the brake member 79 to the base section 72 and on the rod end of cylinder 85 to retract it while clutch section 74 is vented to deactivate it and the closed end of cylinder 85 is vented to allow it to be retracted. When valve 90 is transferred, the pressure is imposed on clutch section 74 to activate it and on the closed end of cylinder 85 to extend it while the brake section 75 is vented to deactivate it and the rod end of cylinder 85 is vented to allow it to be extended. The throttling valve 91 serves to delay the extension of the piston rod 88 until the clutch section 74 is activated and the brake section 75 is deactivated. The throttling valve 92 serves to delay the retraction of piston rod 88 until the clutch section 74 is deactivated and the brake section 75 is activated sufficiently to fix the brake member 79 with respect to the base section 72. By delaying the retraction of fluid cylinder 85 until the brake member 79 is fixed with respect to the base section 72, rotation of the transfer shaft 70 through the same angle $A_R$ as base plate 80 and base section 72 when piston rod 88 is retracted is insured. Thus, the chains 49 and pusher assemblies 60 will be shifted the same distance in the counterclockwise direction as seen in FIGS. 2 and 4.

The solenoid valve 90 is controlled by appropriate switches in the accumulating section 12 and an appropriate cam switch arrangement 94 operatively associated with transfer shaft 70 as seen in FIG. 4. The cam switch arrangement 94 is designed to permit the clutch section 74 to remain activated so as to cause the transfer shaft 70 to be rotated through an angle $A_T$ in the counterclockwise direction as seen in FIG. 4 each time clutch section 74 is activated to connect it to drive unit 42. Angle $A_T$ is equal to 360° plus angle $A_R$. Since the second drive unit 44 rotates the transfer shaft 70 in the clockwise direction through angle $A_R$ as seen in FIG. 4 each time after the first drive unit has rotated shaft 70 through angle $A_T$, shaft 70 is rotated a net 360° or one revolution during each cycle of operation of the connecting unit 45. This insures repeatability of movement during each loading cycle.

The chain and sprocket arrangement 71 thus drives the drive shaft 52 to move the pusher assemblies 60 in the counterclockwise direction around chains 49 the distance $d_T$ to an intermediate position $P_I$ shown in dashed lines in FIGS. 2 and 4 each time the clutch section 74 drivingly connects the first drive unit 42 thereto and then moves the pusher assemblies 60 in the clockwise direction around chains 49 the distance $d_R$ back to a final position $P_F$ shown in solid lines in FIG. 2 and 4 each time the brake section 75 drivingly connects the second drive unit 45 thereto during each cycle of operation. It will be noted that each pusher assembly 60 occupies the same position as the pusher assembly 60 adjacent thereto in the counterclockwise direction as seen in FIGS. 2 and 4 had when the cycle of operation was started.

The distance $d_R$ is selected such that it is slightly greater than the length of the end flaps attached to the side flaps of the tray at the loading position. The final positions $P_F$ are oriented so that one of the pusher assemblies 60 will always be located adjacent the trailing row of containers in the charge being accumulated at the accumulating position (i.e. to the left of the charge as seen in FIG. 2) at the end of a loading cycle. Thus, each time the loading conveyor 14 is cycled, the pusher assembly 60 adjacent the accumulating position at the beginning of the cycle will engage the charge of containers accumulated at the accumulating position and move the charge toward the loading position along the loading path $P_L$ (to the right as seen in FIG. 2). The distance $d_P$ between the pusher assemblies 60 is selected so that none of the pusher assemblies 60 will be located in interference with the incoming rows of containers into the accumulating position when the pusher assemblies 60 are in their final positions $P_F$.

The loading position is located along the loading path $P_L$ downstream of the accumulating position so that a charge of containers will be fully loaded into the tray when the pusher assembly 60 moving same is at its intermediate position $P_I$ as best seen in FIG. 4. Then, when the pusher assembly 60 is retracted the distance $d_R$ to its final position $P_F$, the pusher assembly 60 will be retracted sufficiently to clear the unclosed end flaps attached to the side flaps on the tray as the loaded tray is moved away from the loading position along a path normal to the loading path. Likewise, this same pusher assembly will clear the unclosed end flaps attached to the side flaps as the next unloaded tray is moved into loading position.

Unlike the prior art, it will be appreciated that a charge of containers need not be moved all the way from the accumulating position to the loading position during each cycle of operation of the conveyor 41 since the pusher assemblies 60 return to the accumulating position along the upper flights 56 of chains 49. This allows the amount of movement of the pusher assemblies 60 during each cycle of operation to be minimized while at the same time permitting the loading position to be located at a convenient distance from the accumulating position with affecting the cycle time of the loading operation. Where the pusher assembly 60 at the accumulating position is located in its final position $P_F$ the samme distance from the center of the charge being accumulated as the pusher assembly 60 at the loading position is located in its final position $P_F$ from the center of the charge of containers loaded into the tray, the center to center distance $d_c$ seen in FIG. 4 between the accumulating position and the loading position can be any whole integer multiple of the distance $d_p$ between pusher assemblies 60. For instance, in the machine illustrated, the distance $d_c$ is twice distance $d_p$. When the distance $d_c$ is equal to the distance $d_p$, each accumulated charge will be advanced from the accumulating position to the loading position during each cycle of operation of loading conveyor 41. When the distance $d_c$ is a whole integer multiple of distance $d_p$ of two or more, each accumulated charge will be incrementally advanced during each loading cycle through one or more holding positions before the loading position is reached.

While the connection unit 45 is illustrated mounted on transfer shaft 70, it is understood that the unit 45 may be mounted directly on the drive shaft 52 without departing from the scope of the invention. By mounting the connection unit 45 on transfer shaft 70, however, the amount of rotation of shaft 52 during each loading cycle can be changed without changing the amount of rotation of shaft 70 simply by changing the size of the chain and sprocket arrangement 71 connecting shafts 52 and 70. This facilitates changing the amount of movement of the pusher assemblies 60 to load different size charges of containers.

The loading conveyor 41 can be adjusted for different width charges of containers by using pusher bars 65 of different lengths. Likewise, conveyor 41 can be adjusted for different length charges of containers by spacing the pusher assemblies 60 at different distances $d_p$ and appropriately changing the distance $d_T$ each pusher assembly 60 is advanced during each loading cycle. By appropriately orienting the loading section 14 on the machine 10, it will be appreciated that the loading section 14 can be made to load trays located on either side of the infeed paths of the containers.

While separate drive means are illustrated for moving the chains 49 on the loading conveyor 41 in each direction, it is to be understood that such movement in both directions can be provided by a single drive means. Likewise, it is to be understood that other types of drive mechanisms may be substituted for the drive units 42 and 44 illustrated.

While the drawings illustrate moving the pusher assembly 60 at the loading position out of interference with the unclosed end flaps on the tray by moving the conveyor chains 49, it is to be understood that this pusher assembly may be moved out of interference with the end flaps on the tray without moving the chains 49. For instance, appropriate cams may be used to pivot at that portion of the pusher assembly in interference with the tray out of such interference after the tray has been loaded. Also, the pusher assembly may be constructed to shift with respect to the tray without chains 49 being moved.

OPERATION

In operation, it will be appreciated that the tray loading machine 10 is appropriately interconnected through its control circuit to the tray handling machine associated therewith to synchronize the operation of the two machines. While the pusher assemblies 60 are held in their final positions $P_F$, the infeed section 11 feeds the parallel rows of containers into the accumulating section 12. At the same time, the tray handling machine moves a partly setup tray into the loading position. When the charge of containers has been accumulated in the accumulating position as detected by the detection switches 36 on the stop mechanism 28 and an empty tray is in position at the loading position as indicated by an appropriate switch in the tray handling machine, the loading cycle is initiated. Upon initiation of the loading cycle, the clamping plates 34 in the lockout mechanism 32 are lowered to clamp the containers immediately upstream of the accumulated charge in place. The stop bars 29 on the stop mechanism 28 are retracted and the movable guide plates 24 between the rows of containers in the accumulating position are lowered. At this time, an appropriate switch is made in the accumulating section 12 to initiate the cycle of operation of the loading section 14.

The pusher assemblies 60 are located at the positions shown in FIGS. 2 and 4 at the beginning and end of the cycle of operation of loading section 14. For sake of clarity, these locations have been referenced A-F on FIGS. 2 and 4 with location A adjacent the accumulating position, location B adjacent the holding position, and location C adjacent the loading position. During each cycle of operation, each pusher assembly 60 advances one location in the counterclockwise direction as seen in FIGS. 2 and 4.

The cycle of operation of the loading section 14 is initiated by transferring valve 90. This deactivates brake section 75 and activates clutch section 74 in the connection unit 45 so that the first drive unit 42 moves the conveyor chains 49 in conveyor 41 in a counterclockwise direction to advance each of the pusher assemblies 60 to the intermediate position $P_I$ at the next adjacent location. During this time, the cylinder 85 has rotated the base section 72 on connection unit 45 to its extended position. The cam switch arrangement 94 then causes valve 90 to move back to its normal position to deactivate clutch section 74 and activate brake section 75. This momentarily stops the movement of the pusher assemblies 60 in the intermediate positions $P_I$. After brake section 75 is activated, the piston rod 88 of cylinder 85 is retracted to move the conveyor chains 49 in a clockwise direction until the pusher assemblies 60 are retracted from the intermediate positions $P_I$ back to the final positions $P_F$ at the location to which each has been advanced. The brake section 75 remains activated until the next cycle of operation is initiated to hold the pusher assemblies 60 in the final positions $P_F$.

During each cycle of operation, then, the pusher assembly 60 at location A is advanced to location B, assembly 60 at location B is advanced to location C, assembly 60 at location C is advanced to location D, and assembly 60 at location F is advanced to location A. As pusher assembly 60 at location A moves toward location B, the pusher bar 65 thereon engages the trailing row of containers in the accumulated charge in the accumulating position and moves them toward the holding position. This first pushes the rows of containers in the accumulated charge together and then advances the accumulated charge as a unit along path $P_L$ toward the holding position. When the pusher assembly 60 from location A reaches the intermediate position $P_I$ at location B, the charge of containers from the accumulating position is at the holding position. The pusher assembly 60 moves back away from the charge leaving the charge in the holding position as the pusher assembly moves from the intermediate position $P_I$ back to the final position $P_F$ at location B.

As the pusher assembly 60 at location B moves toward location C, the pusher bar 65 thereon engages the trailing end of the charge of containers in the holding position as the pusher assembly moves through the intermediate position $P_I$ at location B and then moves the charge toward the loading position along path $P_L$. This movement causes the charge to engage and deflect the flap openers 69 to insure that the end flaps attached to the side flaps on the tray are opened and the charge to be inserted into the tray at the loading position. When the pusher assembly 60 from location B reaches the intermediate position $P_I$ at location C, the charge of containers is fully inserted into the tray at the loading position and the pusher bar 65 on assembly 60 has cleared the flap openers 69 so that they are spring urged back to their normal positions to clear the unclosed end flaps on the tray. In the intermediate position $P_I$ at location C, however, it will be noted that the pusher assembly 60 lies between the end flaps attached to the side flaps on the tray so as to interfere with the movement of the loaded tray away from the loading position. The pusher assembly 60 is then moved back away from the charge leaving the charge in the loading position in the tray as the pusher assembly moves from the intermediate position $P_I$ to the final position $P_F$ at location C. In position $P_F$ at location C, the pusher assembly 60 clears the end flaps attached to the side flaps on the tray so that the tray handling machine can move the loaded tray out of loading position and can move another unloaded tray into loading position without interference with the pusher assembly.

As pusher assembly 60 at location C is moved to location D, it passes between the unclosed end flaps attached to the side flaps on the unloaded tray and then up out of the tray as it moves around the drive sprockets 50. It will thus be appreciated that the drive sprockets 50 must be located with respect to the loading position so that the pusher assembly 60 will be raised out of the tray before the closed end flaps at the opposite end of the tray are reached. Thus, as pusher assembly 60 moves from location C to location D, it is moved out of the way of the charge of containers being moved into the tray from the holding position.

As the pusher assembly 60 moves from location F to location A, it passes around the idler sprockets 51 back onto the lower flights 55 of chains 49. Because the pusher bar 65 on the pusher assembly is moved at a faster linear speed as assembly 60 passes around sprockets 51 than that at which it moves along the lower flights 55 of chains 49, it is important that the sprockets 51 be located with respect to the accumulating position so that the pusher assembly 60 will clear the sprockets 51 before the charge of containers are the accumulating position are engaged by the pusher assembly.

At the completion of the loading cycle of the loading section 14, an appropriate switch, usually associated with the transfer shaft 70, is made to activate the tray handling maching so as to move the loaded tray out of the loading position and to move another partly setup tray into the loading position. At the same time, the accumulating section 12 is reactivated to cause the stop bars 29 on the stop assembly 28 to be extended and the movable guide plates 24 to be raised. As soon as this occurs, the clamping plates 34 in the lockout mechanism 32 are raised so that the infeed section 11 again moves the rows of containers into the accumulating section 12 to accumulate another charge of containers. When another charge of containers has been accumulated at the accumulating position, the loading cycle is repeated so that the charge of containers at the holding position is loaded into the tray while the accumulated charge of containers is moved from the accumulating position to the holding position during each loading cycle.

What is claimed as invention is:

1. A tray loading mechanism for moving accumulated charges of containers from an accumulating position into trays at a loading position through the unclosed end flaps of the trays to load the trays comprising:

loading conveyor means including a plurality of pusher means movable between the accumulating and loading positions along an endless path, each of said pusher means adapted to move a charge of containers from the accumulating position into a tray at the loading position as said pusher means moves in a first direction along the endless path;

drive means for moving said plurality of pusher means along the endless path in successive increments of movement so that all of said pusher means are first simultaneously moved along the endless path in the first direction for a first prescribed distance and then simultaneously moved along the endless path in the opposite direction for a second prescribed distance less than the first prescribed distance during each increment of movement so that said plurality of pusher means moves between the accumulating and loading positions in the first direction along the endless path, said first prescribed distance selected to cause one of said pusher means to move a charge of containers out of the accumulating position toward the loading position and to cause one of said pusher means to load a charge of containers into the tray at the loading position during each movement of said plurality of pusher means in the first direction, and said second prescribed distance selected to cause that pusher means loading a charge of containers into the tray at the loading position to move out of interference with the unclosed end flaps on the tray during movement of said pusher means in the second direction.

2. The tray loading mechanism of claim 1 wherein said drive means includes:

first drive means;

second drive means; and connection means for alternatively connecting and disconnecting said first drive means to said loading conveyor means to successively advance said plurality of pusher means said first prescribed distance along the endless path in the first direction each time said first drive means is connected to said conveyor means, said connection means further connecting said second drive means to said conveyor means when said first drive means is disconnected from said conveyor means to move said plurality of pusher means said second prescribed distance along the endless path in the opposite direction.

3. The tray loading mechanism of claim 2 further including slide plate means for slidably supporting the charge of containers as said pusher means moves the charge of containers from the accumulating position into the tray and guide means for guiding the charge of containers along a prescribed loading path between the accumulating and loading positions.

4. The tray loading mechanism of claim 3 wherein said loading conveyor means includes endless support means supported for movement along said endless path, said plurality of pusher means mounted on said endless support means at equally spaced apart positions along said endless support means.

5. The tray loading mechanism of claim 4 wherein said endless support means includes a lower flight and an upper flight oriented so that said pusher means engage the charge of containers to move same from the accumulating position into the tray at the loading position as said pusher means move along the lower flight of said endless support means and said pusher means move from the loading position back to the accumulating position along the upper flight of said endless support means without engaging the charges of containers.

6. The tray loading mechanism of claim 5 wherein the distance between the accumulating position and the loading position, and the spacing between said plurality of pusher means is such that one of said pusher means is located adjacent the accumulating position to engage a charge of containers at the accumulating position when another of said pusher means is located adjacent the loading position.

7. The tray loading mechanism of claim 2 wherein said connection means includes:

a clutch mechanism having an input member driven by said first drive means and an output member drivingly connected to said loading conveyor means so that, when said clutch mechanism is activated, said output member is drivingly connected to said input member to cause said first drive means to move said plurality of pusher means in the first direction along the endless path;

a brake mechanism having a base member driven by said second drive means and a braking member drivingly connected to said loading conveyor means so that, when said brake mechanism is activated, said braking member is drivingly connected to said base member to cause said second drive means to move said plurality of pusher means in the opposite direction along the endless path; and control means for successively activating said clutch mechanism to cause said plurality of pusher means to move said first prescribed distance along the endless path in said first direction each time said clutch mechanism is activated and for successively activating said brake mechanism each time said clutch mechanism is deactivated to cause said plurality of pusher means to move said second prescribed distance along the endless path in the opposite direction.

8. The tray loading mechanism of claim 7 wherein said second drive means includes a fluid cylinder operatively connected to said base member to rotate said base member in one direction as said fluid cylinder is extended and to rotate said base member in the opposite direction as said fluid cylinder is retracted and wherein said control means extends said fluid cylinder while said clutch mechanism is activated and said brake mechanism is deactivated, and retracts said fluid cylinder while said clutch mechanism is deactivated and said brake mechanism is activated.

9. The tray loading mechanism of claim 8 wherein said control means further includes delay means for delaying retraction of said fluid cylinder until said brake mechanism is activated sufficiently to drivingly connect said base member and said brake member.

10. The tray loading mechanism of claim 8 wherein said clutch mechanism and said brake mechanism are activated by fluid under pressure and wherein said control means includes a control valve and a throttling valve, said control valve having a first position supplying fluid under pressure to said clutch mechanism to activate same and to said fluid cylinder to extend same, and having a second position supplying fluid under pressure to said brake mechanism to activate same and to said fluid cylinder through said throttling valve to delay the retraction of said fluid cylinder until said brake mechanism is activated sufficiently to drivingly connect said base and brake members.

11. A method of loading charges of containers from an accumulating position into a tray at a loading position through the unclosed end flaps on the tray comprising the steps of:

(a) positioning a plurality of pusher members for movement along an endless path between the accumulating position and the loading position;

(b) simultaneously advancing all of the pusher members along the endless path in a first direction in successive increments of movement of a first prescribed distance each so that during each increment of movement, one of the pusher members will move the accumulated charge of containers at the accumulating position toward the loading position and one of the pusher members will load a charge of containers into the tray at the loading position; and (c) after each increment of movement of all of the pusher members in the first direction, retracting all of the pusher members along the endless path in the opposite direction for a second prescribed distance sufficient for the pusher member at the tray to clear the end flaps thereof but less than the first prescribed distance so that the pusher members move from the accumulating position to the loading position and back to the accumulating position in the first direction along the endless path.

12. The method of claim 11 further including the step of slidably supporting each charge of containers during movement between the accumulating and loading positions.

13. The method of claim 12 further including the step of confining each charge of containers along opposite sides thereof during movement between the accumulating and loading positions.

14. The method of claim 11 wherein step (b) includes advancing the pusher members in the first direction along the endless path with first drive means and wherein step (c) includes retracting the pusher members in the opposite direction along the endless path with second drive means.

15. The method of claim 11 wherein step (a) includes locating the pusher members along the endless path so that one of the pusher members will have loaded a charge of containers into the tray at the end of each increment of movement in step (b) and so that another of the pusher members will be located adjacent the accumulating position at the end of the retraction of the pusher members in step (c).

16. The method of claim 15 wherein step (b) includes moving each charge of containers at the accumulating position to an intermediate holding position and moving a charge of containers from an intermediate holding position into the tray at the loading position during each increment of movement in the first direction.

* * * * *